US008973419B2

(12) United States Patent
Kasai et al.

(10) Patent No.: US 8,973,419 B2
(45) Date of Patent: Mar. 10, 2015

(54) ROLLING MILL AND METHOD OF ZERO ADJUSTMENT OF ROLLING MILL

(75) Inventors: Daisuke Kasai, Tokyo (JP); Atsushi Ishii, Tokyo (JP); Shigeru Ogawa, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/581,683

(22) PCT Filed: Apr. 11, 2011

(86) PCT No.: PCT/JP2011/059457

§ 371 (c)(1),
(2), (4) Date: Aug. 29, 2012

(87) PCT Pub. No.: WO2011/129453

PCT Pub. Date: Oct. 20, 2011

(65) Prior Publication Data

US 2013/0000371 A1 Jan. 3, 2013

(30) Foreign Application Priority Data

Apr. 13, 2010 (JP) ..... 2010-092054

(51) Int. Cl.
*B21B 37/58* (2006.01)
*B21B 38/08* (2006.01)
*B21B 38/10* (2006.01)

(52) U.S. Cl.
CPC ..... *B21B 37/58* (2013.01); *B21B 38/105* (2013.01)
USPC ..... 72/10.4; 72/14.4; 72/241.4

(58) Field of Classification Search
USPC ..... 72/8.3, 10.4, 10.6, 12.1, 12.7, 12.8, 72/13.4, 14.4, 20.1, 21.4, 241.2, 241.4, 72/241.8
See application file for complete search history.

(56) References Cited

U.S. PATENT DOCUMENTS 4,570,472 A 2/1986 Kuwano
6,401,506 B1 * 6/2002 Ogawa et al. ..... 72/14.4

(Continued)

FOREIGN PATENT DOCUMENTS

JP 55-156610 12/1980
JP 58-51771 11/1983

(Continued)

OTHER PUBLICATIONS

International Search Report dated May 17, 2011, issued in corresponding International Application No. PCT/JP2011/059457.

*Primary Examiner* — Debra Sullivan
(74) *Attorney, Agent, or Firm* — Kenyon & Kenyon LLP

(57) ABSTRACT

The present invention discovers that a rolling direction force occurs even with conventional adjustment by the kiss roll state, pinpoints that the rolling direction force does not affect the roll thrust force, and thereby enables more precise initial roll gap position adjustment of a rolling mill (rolling zero adjustment).

That is, this is based on the fact that high precision rolling zero adjustment becomes possible without being affected by any thrust force acting between rolls if performing differential asymmetrical roll gap zero point adjustment of the work side and the drive side so that the difference of the rolling direction forces acting on the roll chocks of the work side and the drive side of the work roll at the work side and the drive side (in practice, within ±5% of the sum of the rolling direction forces at the work side and the drive side).

8 Claims, 5 Drawing Sheets

(56) References Cited

U.S. PATENT DOCUMENTS

| | | | |
|---|---|---|---|
| 7,310,982 | B2 | 12/2007 | Ogawa et al. |
| 2002/0053230 | A1 | 5/2002 | Ogawa et al. |

FOREIGN PATENT DOCUMENTS

| | | |
|---|---|---|
| JP | 59-191510 | 10/1984 |
| JP | 2554978 | 11/1996 |
| JP | 2604528 | 4/1997 |
| JP | 3422930 | 7/2003 |
| JP | 3438764 | 8/2003 |
| JP | 3487293 | 1/2004 |
| JP | 3499107 | 2/2004 |
| JP | 3505593 | 3/2004 |
| JP | 3701981 | 10/2005 |
| JP | 2006-116569 | 5/2006 |
| JP | 2008-161934 | 7/2008 |
| JP | 4214150 | 1/2009 |

* cited by examiner (PRIOR ART)

ROLLING MILL AND METHOD OF ZERO ADJUSTMENT OF ROLLING MILL

This application is a national stage application of International Application No. PCT/JP2011/059457, filed Apr. 11, 2011, which claims priority to Japanese Application No. 2010-092054, filed Apr. 13, 2010, the content of which is incorporated by reference in its entirety.

TECHNICAL FIELD

The present invention relates to a rolling mill and a method of zero adjustment of the same, in particular relates to a rolling mill which enables high precision zero adjustment in left and right asymmetric components of the rolling mill and a method of zero adjustment of the same.

BACKGROUND ART

One of the important issues in rolling operations of metal plate and sheet materials is to make the elongation rate of the rolled material equal at the work side and the drive side. Hereinafter, for simplification of expression, the work side and the drive side will be referred to as the "left" and "right". If the elongation of the rolled material becomes uneven at the left and right, camber and plate thickness wedges, that is, defects in the flat shape and dimensional precision of the rolled material, will occur. Not only that, running trouble such as meandering and drawing will sometimes occur.

As work means for making the left and right elongation rates in rolling of a rolled material equal, eliminating the difference in the roll gap positions of the rolling mill at the work side and the drive side, that is, a left-right asymmetric control of roll gap (work side-drive side asymmetric control of roll gap), is used. Usually, a left-right asymmetric control of roll gap is performed by establishing proper settings before rolling, ensuring suitable operation during rolling, and having the operator carefully observe the rolling operation during work, but it cannot be said that the above-mentioned camber and plate thickness wedge quality defects and running trouble have been able to be sufficiently controlled.

In view of the above issues, PLT 1 discloses the art of performing a left-right asymmetric control of roll gap based on the ratio of the sum of the difference of the load cell loads of the work side and drive side of the rolling mill. Further, PLT 2 discloses the art of performing a left-right asymmetric control of roll gap by directly detecting the offset from the rolled material at the rolling mill entrance side, that is, the meandering.

The arts disclosed in the above PLT 1 and PLT 2 for reducing to zero the difference in elongations of the rolled material at the work side and the drive side illustrated here all aim at optimizing left-right asymmetric control of roll gap as means of control, but in each art, a difference arises in the elongation rate of the rolled material at the work side and the drive side. These are arts for control by the left-right asymmetric control of roll gap and do not optimize the setting of the left-right asymmetric control of roll gap before start of rolling.

One of the most important factors in left-right asymmetric control of roll gap control before the start of rolling is the zero point adjustment of the roll gap position. Usually, in a flat product rolling mill, after rolls are exchanged, zero point adjustment of the roll gap position (hereinafter, also called "roll gap zeroing" or simple "zeroing") is performed. In this method, in the roll turning state, the reduction apparatus is operated to set the kiss roll state then the point of time when the measurement value of the rolling load matches a predetermined zero point adjustment load (setting preset as 15% to 85% of rated load) is made the zero point of the roll gap position. This is often employed after installing new rolls etc.

At this time, the difference between the left and right roll gap positions is usually eliminated, that is, the zero point of left-right asymmetric control of roll gap is also simultaneously adjusted. Regarding the zero point adjustment of left-right asymmetric control of roll gap as well, at the time of the kiss roll state, the measurement values of the rolling load at the work side and the drive side are adjusted to match the predetermined zero point adjustment loads. Note that the "kiss roll state" is the state with no rolled material present where the upper and lower work rolls are made to contact each other and a load is given between the rolls.

PLT 3 discloses a method of zero adjustment which maintains a kiss roll state until the sum of the measurement loads of the work side and the drive side becomes a predetermined value and, while maintaining the sum of the loads at a predetermined value, performs a left-right asymmetric control of roll gap so that the left and right load measurement values become the same.

Now, between work rolls and backup rolls or, in the kiss roll state (state where rolls are "kissing"), between upper and lower work rolls, where the rolls cross, a thrust force (force acting in roll axial direction) is generated between the rolls. FIG. 8 shows the state of thrust force occurring in a four-high rolling mill. This thrust force gives extra moment to the rolls. Due to this, the distribution in the roll axial direction of the contact load between rolls changes to balance with the moment. This in the end appears as external disturbance to the difference of the load cells for use for measurement of rolling load of the rolling mill at the work side and the drive side. The cross angle between the rolls need not be intentionally set like with a pair cross rolling mill and also occurs due to the slight clearance presence between the housing and the roll chocks, so it is difficult to control the cross angle to zero.

For this reason, in the art disclosed in PLT 3, when a thrust force is generated, the left-right asymmetric control of roll gap is performed after being affected by external disturbance on the difference of the load cells for use for measurement of rolling load of the rolling mill at the work side and the drive side, so the roll gap position ends up being mistakenly set.

To isolate the effect of the thrust force, for example PLT 4 discloses the method of giving a difference in peripheral speed at the upper and lower work rolls and concentrating the clearance between the housing and the roll chocks at one side to stabilize the chock positions and thereby reduce fluctuation in the thrust force. Further, PLT 5 discloses a method of making the rotation of the work rolls stop and reducing the thrust force at the time of rolling zero adjustment. PLT 6 discloses a method of making the rotation of the work rolls stop at the time of rolling zero adjustment and changing the position in the roll rotation direction by two levels or more to perform rolling zero adjustment, averaging the roll gap positions found by these respective operations, and using that value as the zero point of the roll gap position (initial roll gap position).

Further, PLT 7 discloses the method of measuring the roll axial directional thrust reaction forces acting on all rolls other than the backup rolls and the backup roll reaction forces acting in the rolling direction at the different rolling support positions at the upper and bottom backup rolls, finding one or both of the zero point of the rolling apparatus and the deformation characteristics of the rolling mill, and using these as the basis to set or control the roll gap positions. Further, PLT 8 discloses the method of using the quantity of left-right asymmetric control of roll gap not causing bending before roll replacement as the basis for determining a differential load target value and performing the rolling zero adjustment.

On the other hand, PLT 9 discloses, as a method of control of left-right asymmetric control of roll gap which suppresses the camber of the rolled material, the method of measuring rolling direction forces acting on roll chocks of the work side and the drive side of the work rolls, calculating the difference of the work side and the drive side of the rolling direction forces (also referred to simply as the "difference"), and making this difference become zero by controlling the left and right asymmetric components of the roll opening degrees of the rolling mill.

REFERENCE SIGNS LIST

Patent Literature

PLT 1: Japanese Patent Publication (B2) No. 58-51771
PLT 2: Japanese Patent Publication (A) No. 59-191510
PLT 3: Japanese Patent No. 2554978
PLT 4: Japanese Patent No. 3505593
PLT 5: Japanese Patent No. 3438764
PLT 6: Japanese Patent No. 3422930
PLT 7: Japanese Patent No. 3701981
PLT 8: Japanese Patent No. 3487293
PLT 9: Japanese Patent No. 4214150

SUMMARY OF INVENTION

Technical Problem

However, in the methods which are described in PLT 4, PLT 5, and PLT 6, the rolling zero adjustment is not performed in the normal roll rotating state, so it is believed that when actually made to rotate at the same peripheral speeds at the upper and bottom, the parallel degree with the adjoining rolls changes slightly. The thrust force between rolls changes in direction and magnitude also due to slight error in parallel degree with the adjoining rolls, so with these methods, high precision rolling zero adjustment is difficult.

Further, in the method described in PLT 7, it is necessary to measure all of the roll axial direction thrust reaction force acting on all rolls other than the backup rolls and the backup roll reaction force acting on the rolling direction at different rolling support positions of the upper and bottom backup rolls. In rolling mills not provided with load measuring devices for measuring all of these, the method cannot be used.

Further, in the method described in PLT 8, the thrust force before replacement of rolls and the thrust force after the replacement of rolls have to act in the same direction by the same extent of magnitude, but as explained above, the thrust force between rolls changes in direction or magnitude due to the slight error in parallel degree with adjoining rolls or changes in surface properties of the rolls, so with this method, high precision rolling zero adjustment is difficult.

In this regard, the method described in PLT 9 has an inhibiting effect on camber during rolling. However, it differs in issues from the above PLTs 1 to 8, so there is no description which contributes to zero adjustment.

Further, the method which is described in PLT 9 relates to control during rolling. Therefore, there is no effect if starting the control after the start of rolling, but it is not possible to suppress camber for the frontmost end which is rolled before starting control. Further, before the rolled material leaves the rolling mill, that is, it is necessary to end the control right before the rolling ends from the viewpoint of stability of control. For resetting the roll gap position to the initial roll gap position after the end of control, if erring in the initial roll gap position (zero point position), it becomes a cause of camber at the tail end of the rolled material. That is, in the method of PLT 9, improvement of the shape quality of the front end and back end of the rolled material is an issue. In particular, the shape quality of the front end and the back end greatly depends on the initial roll gap position (zero point position). A suitable method of setting the initial roll gap position is therefore being sought.

As explained above, the current rolling control methods have the following problems.

(a) As described in PLT 9, it is known that a rolling control method which considers the thrust force is effective, but the front end and back end of a rolled material are strongly affected by the initial roll gap position (zero point position). Suitable control is not possible.

(b) Further, initial roll gap position adjustment (zero point position adjustment or zero adjustment) uses the kiss roll state for adjustment, but this is strongly affected by the thrust force of the rolls. Suitable zero point position adjustment is not possible.

In view of the above problems and situation, the present invention has as its object the provision of a method of rolling zero adjustment which determines the initial roll gap position of the rolling mill (also called "zero point adjustment") wherein in particular the problems relating to the effects of the thrust force are resolved making it possible to provide a rolling mill which is capable of suitable zero point adjustment of roll gap difference and a method of zero adjustment of such a rolling mill.

Solution to Problem

The inventors worked to solve the problem by broad research regarding the method of rolling zero adjustment of a rolling mill and as a result discovered that a rolling direction force occurs even with conventional adjustment by a kiss roll state and pinpointed the fact that the rolling direction force is not affected by the roll thrust force. From these facts, they thought that by performing rolling zero adjustment considering also the rolling direction force, higher precision setting would be possible and obtained the following technical findings:

(A) The backup roll reaction force which acts in the rolling direction is affected by the thrust force between rolls. The difference of the work side and the drive side remarkably changes. However, the difference of the rolling direction forces at the work side and the drive side which act on the roll chocks of the work side and the drive side of the work rolls is not affected by the thrust force between rolls and does not change much at all.

(B) Specifically, when a cross angle occurs between rolls, the difference at the work side and the drive side of the backup roll reaction force which acts on the rolling direction fluctuates depending on the direction and magnitude of the cross angle. However, the difference of the rolling direction force at the work side and the drive side of the work rolls is not affected even if the direction and magnitude of the cross angle changes and remains substantially constant.

(C) That is, if performing zero point adjustment of roll gap difference of the work side and the drive side so that the difference of the rolling direction force at the work side and the drive side of the work rolls becomes generally zero, in actuality, within ±5% of the average value of the rolling direction forces at the work side and the drive side (or becomes within ±2.5% of the sum of the rolling direction forces at the work side and the drive side), even if a thrust force acts between rolls, this has no effect and high precision rolling zero adjustment becomes possible.

Based on these discoveries, the inventors completed the present invention relating to a rolling mill and a method of zero adjustment which realize high precision zero point even if a thrust force acts between rolls at the time of rolling zero adjustment of the rolling mill and enable elimination of flat shape and dimensional precision defects such as camber and plate thickness wedges of the rolled material, or running trouble such as snake motion and tail crush due to poor setting of left-right asymmetric control of roll gap. The gist of the present invention is as follows:

(1) A rolling mill which has at least one upper and lower pair of a work roll and a backup roll, the rolling mill characterized by being provided with load detecting devices for measuring the rolling direction forces in a kiss roll state acting on the roll chocks at the work side of the work roll and on the roll chocks at the drive side, a rolling direction force difference calculating device which calculates a difference of the rolling direction forces acting on the roll chocks at the work side and the roll chocks at the drive side measured by the load detecting devices, a left-right asymmetric roll gap control quantity calculating device which uses the calculated value of the rolling direction force difference calculating device as the basis to calculate the left-right asymmetric roll gap control quantities at the work side and the drive side of the rolling mill, and a left-right asymmetric roll gap control device which controls the rolling devices at the work side and the drive side of the rolling mill based on the calculated values of the left-right asymmetric roll gap control quantity calculating device, the left-right asymmetric roll gap control quantity calculating device calculating the left-right asymmetric roll gap control quantities at the work side and the drive side of the rolling mill so that the sum of the backup roll reaction forces at the work side and the drive side in the kiss roll state becomes a value of within ±2% of a predetermined value and that the difference of the rolling direction forces acting on the roll chocks of the work side of the work rolls and the roll chocks of the drive side becomes a value of ±5% of the average of the work side and the drive side.

(2) A rolling mill as set forth in (1), characterized in that at either of an entrance side and exit side of the rolling direction of the roll chocks of the work side and roll chocks of the drive side, there is a pushing device for pushing the roll chocks of the work side and the roll chock of the drive side in the rolling direction.

(3) A rolling mill as set forth in (1) or (2), characterized in that among an entrance side and exit side at the rolling direction of the roll chocks of the work side and roll chocks of the drive side, a pushing device is provided for pushing the work chocks of the work side and the work chocks of the driven side at the opposite side from the side where the work rolls are offset from the backup rolls.

(4) A rolling mill as set forth in (2) or (3) characterized in that the pushing device has the function of detecting the rolling direction force.

(5) A method of zero adjustment of a rolling mill having at least one upper and lower pair of work rolls and backup rolls characterized by making the sum of the backup roll reaction forces at the work side and the drive side in the kiss roll state become a value of within ±2% of a predetermined value, measuring the rolling direction forces acting at the roll chocks of the work side of the work rolls and the roll chocks of the drive side, calculating the difference between the rolling direction forces at the work side and the drive side, setting the left and right roll gap positions of the rolling mill so that this difference becomes a value of ±5% of the average of the rolling direction forces of the work side and the drive side, and making the set roll gap positions as the initial roll gap positions.

(6) A method of zero adjustment of a rolling mill as set forth in (5), characterized by pushing the roll chocks at the work side and the roll chocks at the drive side in the rolling direction.

(7) A method of zero adjustment of a rolling mill as set forth in (5), characterized by pushing the roll chocks of the work side and the roll chocks of the drive side in the rolling direction from a side opposite to the side at which the work roll is offset from the backup roll among the entrance side and exit side of the rolling direction of the roll chocks at the work side and the roll chocks at the drive side.

Advantageous Effects of Invention

According to the present invention, even if a thrust force acts between rolls, high precision zero point adjustment of roll gap difference, which was difficult with the conventional zero point adjustment of roll gap difference method based on the difference of the backup roll reaction forces acting in the rolling direction between the work side and the drive side, becomes possible.

As a result, the shape quality of the front end and back end of the rolled material becomes better. If combining with this, for example, the method of control during rolling described in PLT 9, it is possible to obtain steel plate with a good shape quality along the entire length of the rolled material.

DESCRIPTION OF EMBODIMENTS

Below, embodiments of the present invention will be explained with reference to the figures. Note that, in the Description and drawings, component elements which have substantially the same functions and configurations are assigned the same reference signs and overlapping explanations are omitted.

Figure 1:
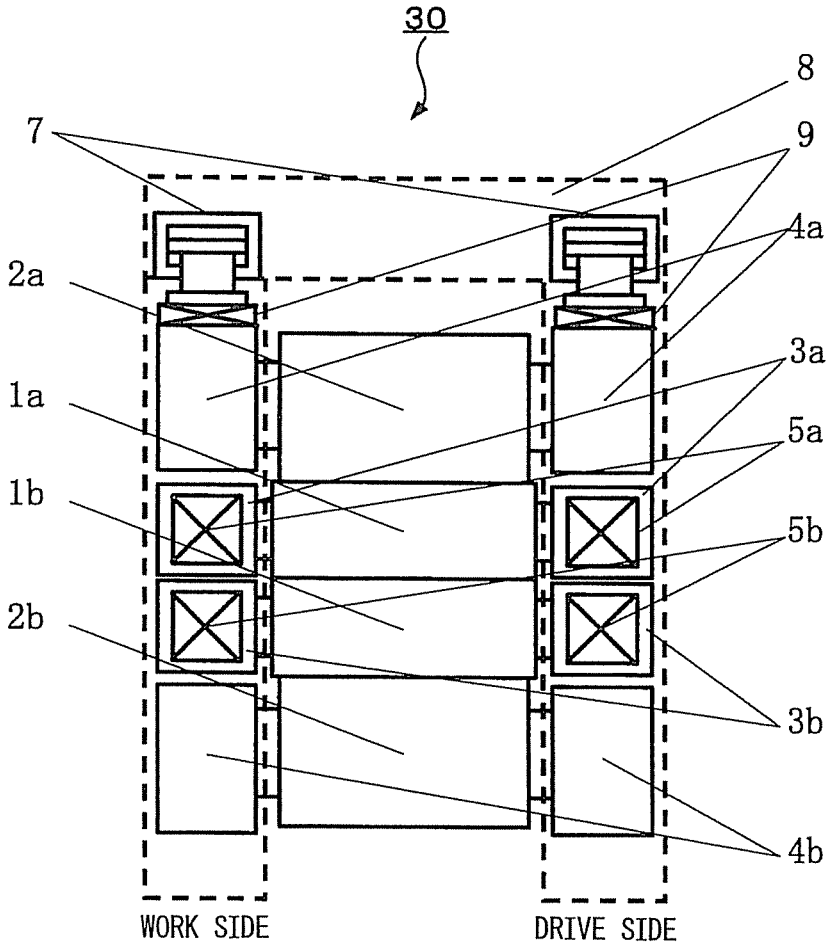
FIG. 1 is a front view of a rolling mill according to an embodiment of the present invention as seen from the rolling direction.
Figure 2:
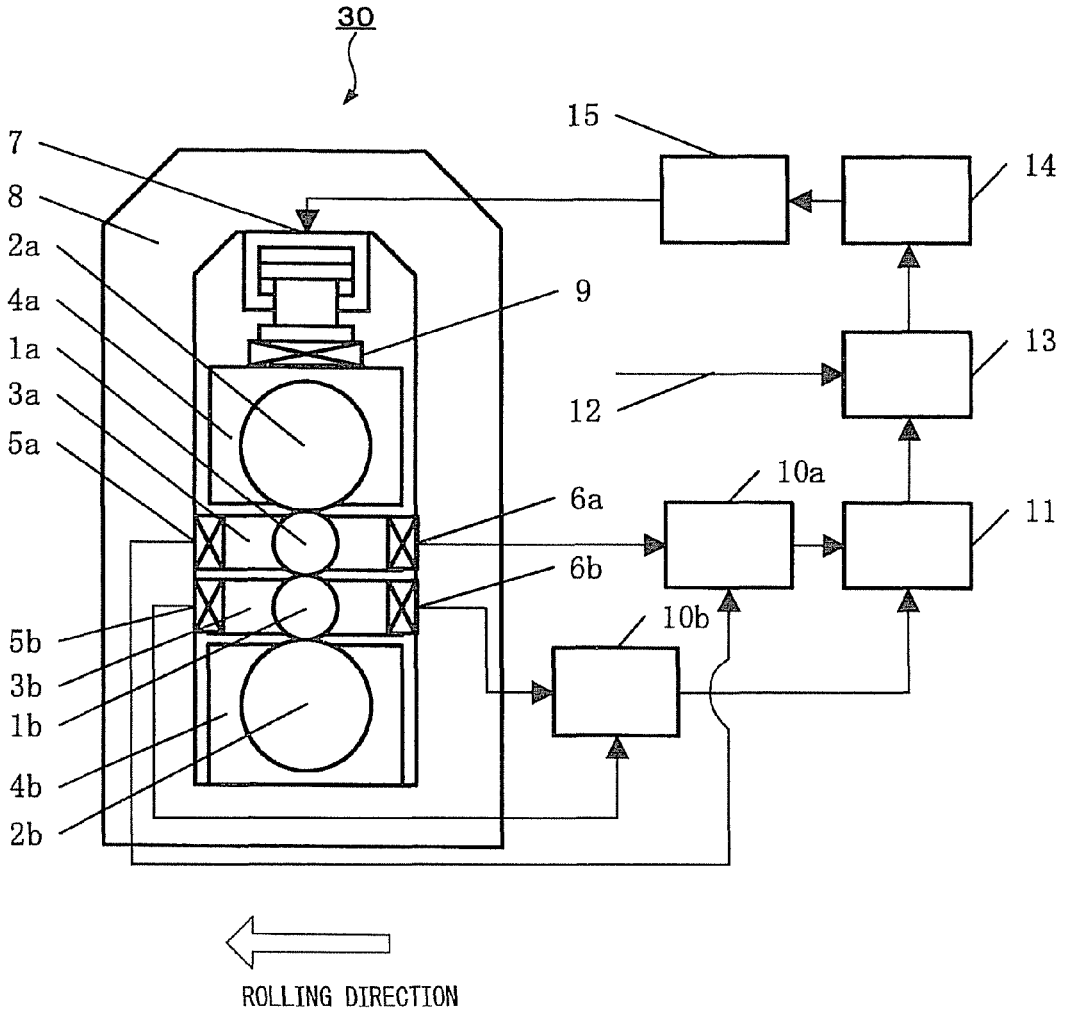
FIG. 2 is an explanatory view of a method of zero adjustment in an embodiment of the present invention.

FIG. 1 is a front view of a rolling mill 30 according to an embodiment of the present invention as seen from the rolling direction. Further, FIG. 2 is a view for explaining the method of zero adjustment in an embodiment of the present invention. In the rolling mill 30, the flow in the case of performing the method of zero adjustment according to the present invention is shown. Note that, FIG. 2 illustrates only the system configuration of the work side for explanatory purposes, but the drive side also has similar not shown devices. Here, the "drive side" means the side, viewing the rolling mill from the front, where the electric motors for driving the work rolls are arranged, while the "work side" means the opposite side.

The rolling mill 30 of FIG. 1 is provided with an upper work roll 1*a* which is supported at upper work roll chocks 3*a*, an upper backup roll 2*a* which backs up the upper work roll 1*a* and is supported at upper backup roll chocks 4*a*, a lower work roll 1*b* which is supported at lower work roll chocks 3*b*, and a bottom backup roll 2*b* which backs up the lower work roll 1*b* and which is supported at bottom backup roll chocks 4*b*. The mill is further provided with hydraulic rolling devices 7. Note that, as shown in FIG. 1, the upper work roll chocks 3*a*, the upper work roll 1*a*, the upper backup roll chocks 4*a*, the upper backup roll 2*a*, the lower work roll chocks 3*b*, the lower work roll 1*b*, the bottom backup roll chocks 4*b*, and the bottom backup roll 2*b* are also provided at the drive side.

The rolling direction force which acts on the upper work roll 1*a* of the rolling mill 30 is basically supported by the upper work roll chocks 3*a*. Further, at the upper work roll chocks 3*a*, the upper work roll chock exit side load detecting devices 5*a* and the upper work roll entrance side load detecting devices 6*a* are provided. Due to these load detecting devices 5*a* and 6*a*, it is possible to measure the force acting between the housing 8 fastening the upper work roll chocks 3*a* in the rolling direction, the project blocks, or other members and the upper work roll chocks 3*a*. These load detecting devices 5*a* and 6*a* are usually structured to measure the compression force because this is preferable for simplifying the system configuration.

Load detecting devices which detect the rolling direction force acting on the roll chocks may be set at just one side of the roll chocks if able to suitably measure the load (either entrance side or exit side). FIG. 1 shows the case where the devices are provided at both sides of the roll chocks. Below, the explanation will be given based on the example of FIG. 1.

Further, FIG. 2 shows the system configuration according to the present invention. To enable rolling zero adjustment before rolling, the kiss roll state is set. At this time, there is no rolling direction force. A rolling direction force is also generated. The rolling direction force which acts on the upper work roll chocks 3*a* is measured by the upper work roll chock exit side load detecting devices 5*a* and the upper work roll entrance side load detecting devices 6*a*. The upper work roll rolling direction force calculating device 10*a* calculates the difference in measurement results by the upper work roll exit side load detecting devices 5*a* and the upper work roll entrance side load detecting devices 6*a* and calculates the rolling direction force which acts on the upper work roll chocks 3*a*.

Furthermore, in the same way for the rolling direction force which acts on the lower work roll 1*b*, the measurement results of the lower work roll exit side load detecting devices 5*b* and the lower work roll entrance side load detecting devices 6*b* which are provided at the exit side and entrance side of the lower work roll chocks 3*b* are used as the basis for the lower work roll rolling direction force calculating device 10*b* to calculate the rolling direction force which acts on the lower work roll chocks 3*b*. Here, the "entrance side" and the "exit side" are added for convenience. They do not necessarily have to match the actual sides at which the rolled material enters and exits. In this application, the right side illustrated in FIG. 2 is defined as the "entrance side" while the left side illustrated is defined as the "exit side". Further, in calculation, it is necessary to consider the direction of the force. For example, the rolling exit side direction is made the positive direction and the force which actually acts on roll chocks is found. In the case of the above means (2), a pushing force acts on the roll chocks, so it is possible to cancel out that quantity.

Next, the work roll rolling direction composite force calculating device 11 obtains the sum of the calculated result of the upper work roll rolling direction force calculating device 10*a* and the calculated result of the lower work roll rolling direction force calculating device 10*b* and calculates the rolling direction composite force which acts on the upper and lower work rolls. In FIG. 2, only the calculation at the work side is illustrated for the explanation, but the above procedure is performed not only at the work side, but also by exactly the same system configuration at the drive side. The result is obtained as the drive side work roll rolling direction composite force 12. Further, the work side-drive side rolling direction force difference calculating device (rolling direction force difference calculating device) 13 calculates the difference between the calculated result of the work side and the calculated result of the drive side, whereby the difference of the rolling direction forces which act on the work roll chocks (upper work roll chocks 3*a* and lower work roll chocks 3*b*) at the work side and the drive side (difference of rolling direction forces between work side and drive side) is calculated.

In the example shown in FIG. 2, the difference in rolling forces acting on the roll chocks at the drive side and the work side is calculated by the upper work roll rolling direction force calculating device 10*a*, the lower work roll rolling direction force calculating device 10*b*, and the work roll rolling direction composite force calculating device 11, and, further, the work side-drive side rolling direction force difference calculating device (rolling direction force difference calculating device) 13.

Below, this series of devices up to calculation of the difference in rolling forces applied to the drive side and the work side roll chocks will be referred to all together as the work side-drive side rolling direction force difference calculating device (rolling direction force difference calculating device) 13. This is because, depending on the embodiment, sometimes there is no lower work roll rolling direction force calculating device 10*b* or work roll rolling direction composite force calculating device 11.

Further, the hydraulic rolling devices 7 are simultaneously operated at the work side and the drive side and the rolls closed until the left and right sum of the backup roll reaction forces becomes a preset value (zero adjustment load), then, in that state, a left-right asymmetric control of roll gap is performed to make the difference of the rolling direction force at the work side and the drive side zero. This zero adjustment load is set as a predetermined value of a load value of the same extent as the load which occurs in actual rolling. In an actual rolling mill, it is set so that about 50% of the rated rolling load becomes the actual rolling load, so for example may be set to any value of 15% to 85% of the rated rolling load. Preferably, it should be set to any value of 30% of 70% of the rated rolling load.

The setting error may be made within a range of ±2% of a predetermined value (zero adjustment load). If larger than 2%, the fluctuation in the rolling quantity becomes too great and defects in plate thickness and shape easily occur. There is no problem if kept to a range of ±2% in actual rolling. Of course, it is better that the error is smaller. Preferably, the error is made ±1% or less. This is set in advance depending on the rolled material and the rolling conditions. Details of the method of setting this will be omitted, but the method by which the error is set in ordinary rolling work may be used.

Next, based on the calculated results of the difference of the rolling direction forces at the work side and the drive side (difference at work side and drive side), the control quantities of the hydraulic rolling devices 7 are calculated by the left-right asymmetric roll gap control quantity calculating device 14 so that the difference in the rolling direction forces acting on the work roll chocks (upper work roll chocks 3*a* and lower work roll chocks 3*b*) at the work side and the drive side is made to become zero and the zero adjustment load is maintained. At this time, ideally the difference in the rolling direction forces at the work side and the drive side is generally zero. In practice, there is no problem if, considering measurement error and the setting system, the difference is ±5% or less of the average of the rolling direction forces in the work side and the drive side. Preferably, the difference is ±4% or less, more preferably ±3% or less, still more preferably 2% or less. Further, expressed another way, the difference may be made ±2.5% or less of the sum of the rolling direction forces at the work side and the drive side (that is, the sum of the rolling direction forces acting on the work roll), preferably ±2% or less, more preferably ±1.5% or less, still more preferably 1% or less.

In this regard, how much rolling is applied results in how much of an increase of the rolling direction forces differs due to the rigidity of the rolling mill (mill rigidity) or offset quantity etc. Therefore, it is sufficient to investigate in advance by how much the rolling direction force increases at the time of the kiss roll state if applying a rolling force at just one of either the work side or the drive side and, conversely, by how much the rolling direction force decreases if reducing the rolling force at just one side. The mill rigidity tends to become constant in a certain limited range.

Therefore, for example, when the rolling direction force of the work side is larger than the rolling direction force at the drive side, it is possible to eliminate half of the difference of the two by reducing the quantity of rolling at the work side and to eliminate the remaining half by increasing the quantity of rolling at the drive side. If calculated in this way, it is possible to obtain control quantities which enable the kiss roll load to be substantially maintained while eliminating the difference in the rolling direction forces.

Further, based on the results of calculation of the control quantities, the left-right asymmetric roll gap control device 15 controls the roll gap position of the rolling mill 30. Due to this, the difference in the rolling direction forces acting on the work roll chocks at the work side and the drive side becomes zero. The roll gap position at that time is made the zero point of the roll gap position for each of the work side and the drive side. As explained above, the difference of the rolling direction forces which act on the work roll chocks (upper work roll chocks 3*a* and lower work roll chocks 3*b*) at the work side and the drive side is not affected by the thrust force, so even if a thrust force occurs between rolls, extremely high precision zero point setting of left-right asymmetric control of roll gap can be realized.

Note that, if the difference of the rolling direction forces at the work side and the drive side becomes outside the range of ±5% of the average of the rolling direction forces at the work side and the drive side (that is, if the absolute value of the difference of the rolling direction forces at the work side and the drive side becomes greater than 5% of the average of the rolling direction forces of the two), as a result, zero point setting of the left-right asymmetric control of roll gap is poor and there is the possibility that the advantageous effect of the present invention cannot be significantly obtained. In particular, in the case of a rolling mill like a thick-gauge plate rolling mill where the absolute value of the rated load is large, that is, the absolute value of the zero adjustment load is large, the absolute value of the rolling direction force also becomes larger proportional with the load, so the zero point setting in the left-right asymmetric control of roll gap easily becomes poor.

In this regard, in the system configuration explained above, until the results of calculation of the work side-drive side rolling direction force difference calculating device (rolling direction force difference calculating device) 13 are obtained, basically the outputs of the total eight load detecting devices at the work side and the drive side combined are just added and subtracted. Therefore, it is also possible to change the above system configuration and the order of calculation in any way. For example, it is possible to first add the outputs of the upper and lower exit side load detecting devices, then calculate the difference from the results of addition at the entrance side, and finally calculate the difference of the work side and the drive side or possible to first calculate the difference of outputs of the load detecting devices at the work side and the drive side for each position, then total the upper and lower figures, and finally calculate the difference between the entrance side and the exit side.

According to the method of zero adjustment according to the embodiment explained above, even when a thrust force acts between the rolls at the time of rolling zero adjustment of the rolling mill, high precision zero point adjustment of left-right asymmetric control of roll gap is realized and it is possible to eliminate flat shape and dimensional precision defects such as camber and plate thickness wedges of the rolled material, or running trouble such as snake motion and tail crush from the front end of the rolled material due to poor setting of left-right asymmetric control of roll gap. That is, it is possible to use the minimum extent of measurement equipment to enable high precision zero adjustment at the time of normal roll rotation and perform efficient rolling operations.

Above, one example of embodiments of the present invention was explained, but the present invention is not limited to the illustrated example. A person skilled in the art clearly could conceive of various changes and modifications within the scope of the concepts described in the claims. These are naturally also understood as falling under the technical scope of the present invention.

Figure 3:
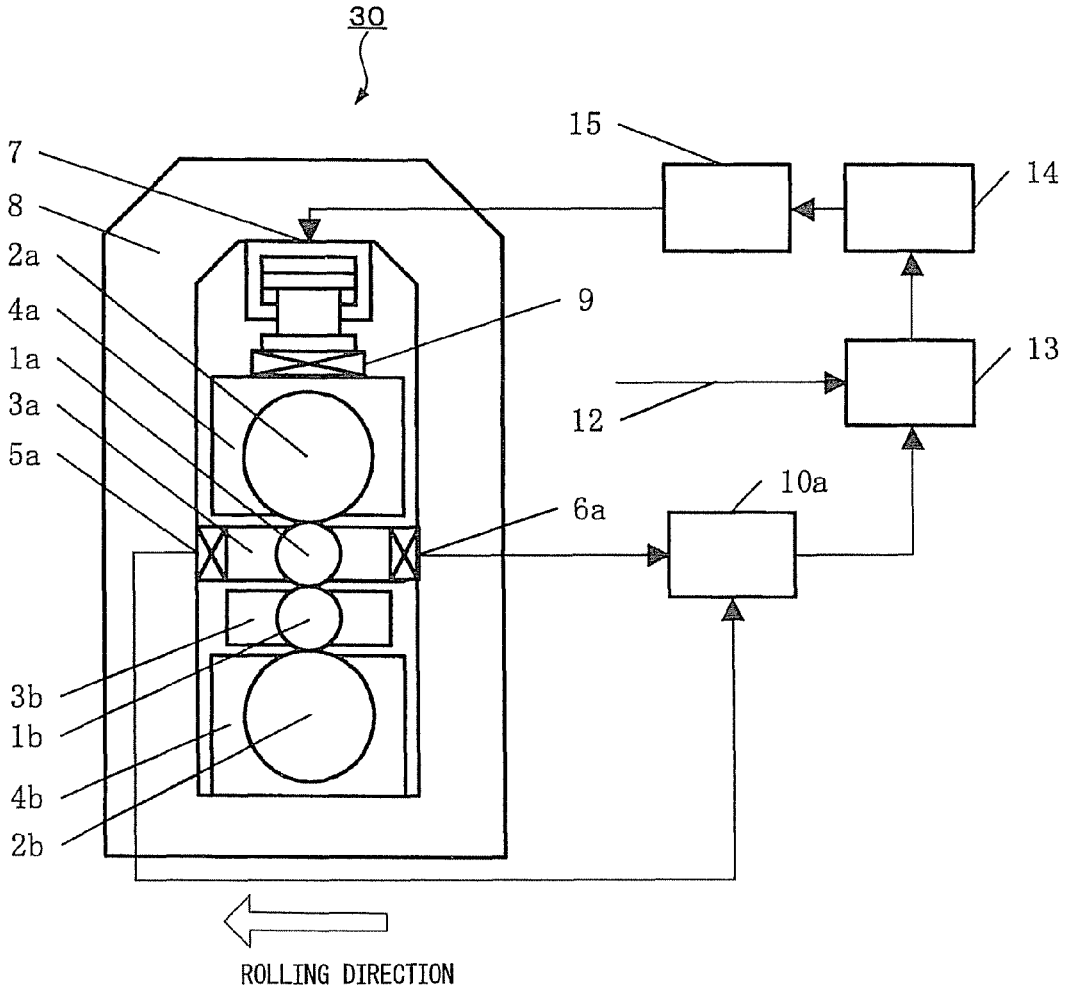
FIG. 3 is an explanatory view of a method of zero adjustment in another embodiment of the present invention.

FIG. 3 is an explanatory view of a method of zero adjustment in another embodiment of the present invention. In the other embodiment shown in FIG. 3, compared with the embodiment shown in FIG. 2, the detecting device and calculating device of the rolling direction force acting on the lower work roll chock are omitted. In general, in the kiss roll state where the upper and lower work rolls rotate at the same peripheral speed, the difference between the rolling direction forces acting on the work roll chocks at the work side and the drive side is never enough to cause the upper and lower work rolls to rotate in opposite directions. Therefore, by using the left-right asymmetric roll gap control quantity calculating device 14 to calculate the suitable control quantity, it is possible to realize excellent zero point adjustment of left-right asymmetric control of roll gap based on the difference of the rolling direction forces acting on either the upper or lower work rolls at the work side and the drive side. FIG. 4 to FIG. 7 are views which explain other examples. Note that, FIG. 4 to FIG. 7 describe only an upper work roll 1*a*, an upper backup roll 2*a*, and an upper work roll chock 3*a* and load detecting devices 5*a* and 6*a* and other peripheral devices arranged there.

Figure 4:
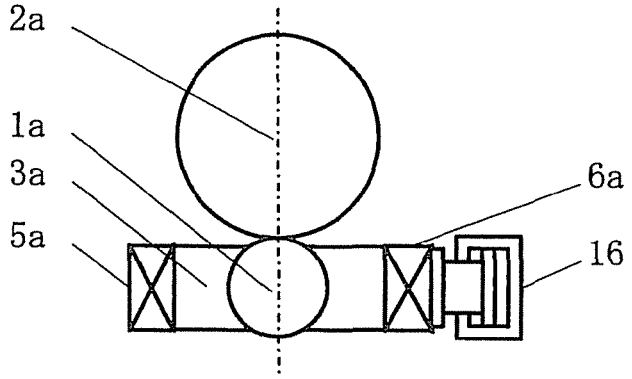
FIG. 4 is an enlarged explanatory view showing an example of the upper work roll and the upper backup roll.

FIG. 4 is an enlarged explanatory view showing an example of the upper work roll 1*a* and the upper backup roll 2*a*. As shown in FIG. 4, at the entrance side of an upper work roll chock 3*a*, there is an entrance side work roll chock pushing device 16 adjoining the upper work roll entrance side load detecting device 6*a*. This pushes the upper work roll chock 3*a* from the entrance side to the exit side by a predetermined pushing force. By adopting such a configuration, it becomes possible to stabilize the rolling direction position of the upper work roll chock 3*a* and improve the response and precision of measurement of the rolling direction force acting on the upper work roll chock 3*a*. In this case, the pushing device 16 is arranged at the outside, when viewed from the work roll, from the load detecting devices of the entrance side and exit side of the work roll chocks.

Figure 5:
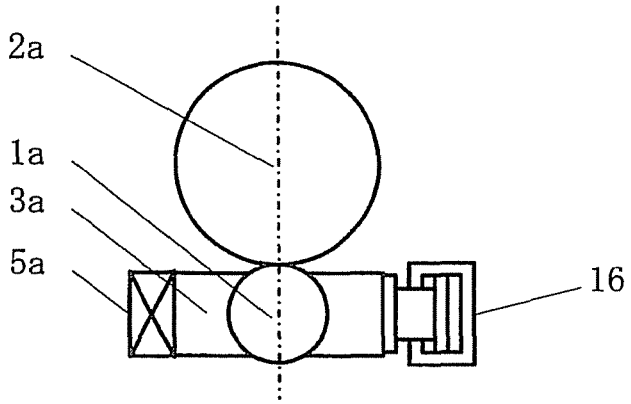
FIG. 5 is an enlarged explanatory view showing a second example of the upper work roll and the upper backup roll.

Further, FIG. 5 is an enlarged explanatory view showing a second example of the upper work roll 1*a* and the upper backup roll 2*a*. As shown in FIG. 5, this is an example where the upper work roll entrance side load detecting device 6*a* is omitted and where a sensor is arranged for measuring the pressure of the working oil which is fed from a hydraulic cylinder of the entrance side work roll chock pushing device 16 of FIG. 4 where the hydraulic device is provided and thereby the hydraulic device is used as a load detecting device. That is, the difference between the measurement value of the upper work roll exit side load detecting device 5*a* and the load detected by the sensor measuring the pressure of the working oil set in the hydraulic cylinder of the entrance side work roll chock pushing device 16 is calculated and the rolling direction force acting on the upper work roll chock 3*a* is calculated. By adopting such a configuration, it is possible to reduce the number of measuring devices more and make the equipment cheaper.

Figure 6:
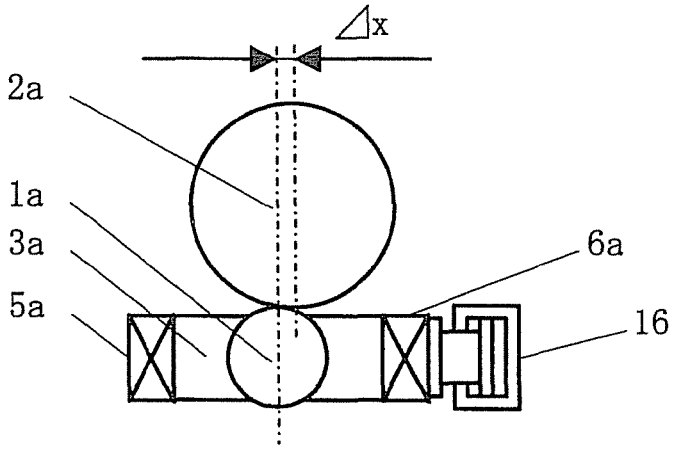
FIG. 6 is an enlarged explanatory view showing a third example of the upper work roll and the upper backup roll in the case where the upper work roll is offset.

Further, FIG. 6 is an enlarged explanatory view of a third example of the upper work roll 1*a* and the upper backup roll 2*a* in the case where the upper work roll 1*a* is offset. As shown in FIG. 6, the upper work roll 1*a* is offset in the exit side direction by exactly Δx, while at the entrance side of the upper work roll chock 3*a*, an entrance side work roll chock pushing device 16 is provided. By arranging the components in this way, the offset force which acts from the upper backup roll 2*a* to the upper work roll 1*a* acts in a direction pushing the upper work roll chock 3*a* to the exit side, so it is possible to reduce the force of the entrance side work roll chock pushing device 16 and possible to obtain a compact, inexpensive facility. Further, in the same way, the force clamping the upper work roll chock 3*a* can be made smaller, so it is also possible to keep other external disturbance factors of control small.

Figure 7:
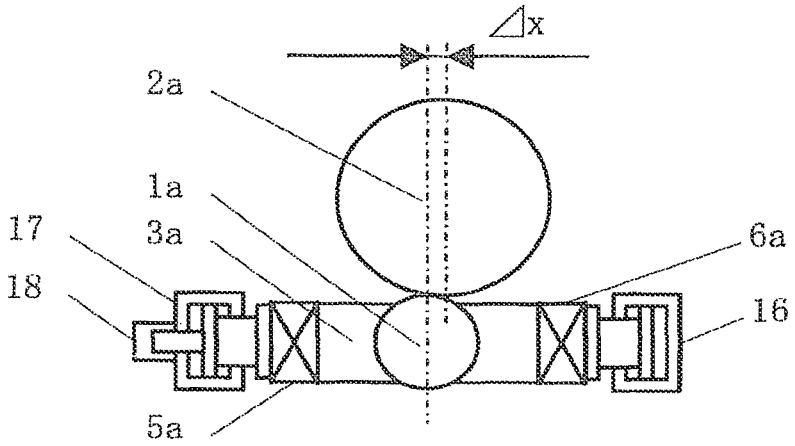
FIG. 7 is an enlarged explanatory view showing a fourth example of the upper work roll and the upper backup roll in the case where the upper work roll is offset and an exit side work roll chock position control device is provided at the exit side of the upper work roll chocks.
Figure 8:
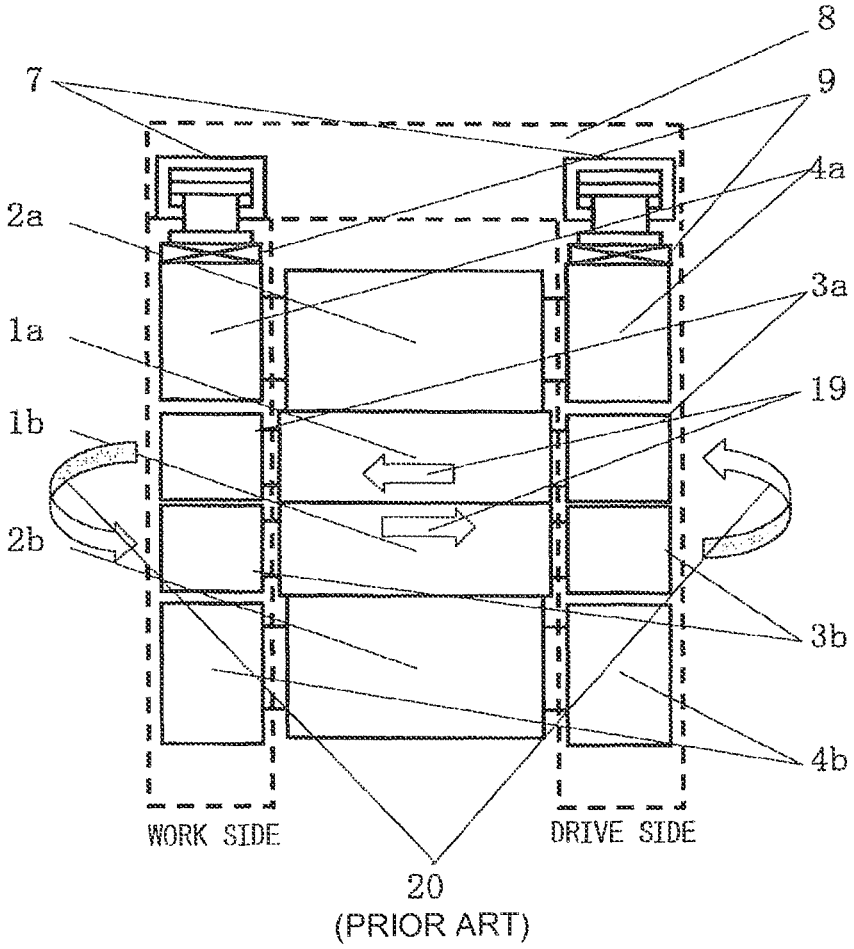
FIG. 8 is an explanatory view showing the state where a thrust force is generated at a conventional four-high rolling mill.

Further, FIG. 7 is an enlarged explanatory view of a fourth example of the upper work roll 1*a* and the upper backup roll 2*a* in the case where the upper work roll 1*a* is offset and where an exit side work roll chock position control device 17 is arranged at the exit side of the upper work roll chock 3*a*. The fourth example shown in FIG. 7 is provided with, in addition to the third example shown in FIG. 6, an exit side work roll chock position control device 17 at the exit side of the upper work roll chock 3*a*. This exit side work roll chock position control device 17 is also a hydraulic pressure device. In the third example of FIG. 6, in form at least, the upper work roll chock 3*a* is clamped by the entrance side and exit side hydraulic pressure cylinders. In the case of the exit side work roll chock position control device 17, an exit side work roll chock position detecting device 18 is arranged to control the position. The force clamping the chock is given by the entrance side work roll chock pushing device 16. By adopting this structure, it becomes possible to given additional control abilities such as the ability of adjustment of the quantity of offset of the work roll or minor cross angle with the backup roll.

Note that, in the examples of FIGS. 4, 5, 6, and 7, examples are shown of provision of a work roll chock pushing device 16 at the rolling mill entrance side, but it may also be arranged at the opposite exit side. However, the relative positional relationship with the work roll offset of FIGS. 6 and 7 has to be maintained. Further, in the examples of FIGS. 4, 5, 6, and 7, only the vicinity of the upper work roll chock 3*a* is shown, but basically the configuration is the same even if applied to the lower work roll chock 3*b*.

EXAMPLE 1

To confirm the advantageous effects of the present invention, kiss roll state tests were run at the heavy-gauge plate rolling mill shown in FIG. 2. The work roll diameter was 1200 mm, while the backup roll diameter was 2400 mm. Further, the rated load was 80000 kN.

As the test method, in the state with any cross angle given between the upper and lower work rolls, a kiss roll state was set to give a sum of backup roll reaction forces at the work side and the drive side of 30000 kN. The rolling zero adjustment position (left-right asymmetrical roll gap zero point) was made the roll gap position where the difference in the backup roll reaction forces in the rolling direction at the work side and the drive side is within 1% of the rated load (in the case of the present embodiment, within 800 kN). Further, this was compared for the quantity of fluctuation due to the change of the cross angle with the case according to the present invention of setting the kiss roll state so that the sum of the backup roll reaction forces at the work side and the drive side becomes a predetermined value and of making the roll gap position where the difference of the rolling direction forces acting on the roll chock at the work side of the work roll and the roll chock at the drive side at the work side and the drive side becomes within 1% of the rated load the rolling zero adjustment position.

When changing the cross angle from −0.1° to +0.1°, with the method of rolling zero adjustment based on the difference of the backup roll reaction forces of the rolling direction at the work side and the drive side, the left-right asymmetrical roll gap zero point changes 0.6 mm, while with the method of rolling zero adjustment according to the present invention based on the difference of the rolling direction forces acting on the roll chocks of the work roll at the work side and the drive side, the change in the left-right asymmetrical roll gap zero point becomes 0.03 mm or less. From this, it is learned that the present invention enables high precision rolling zero adjustment without being affected by any thrust force occurring between rolls due to cross-angle between rolls.

Furthermore, the kiss roll state was set so that the sum of the backup roll reaction forces at the work side and the drive side became 30000 kN and the roll gap position where the difference in the backup roll reaction forces in the rolling direction at the work side and the drive side was within 1% was made the rolling zero adjustment position. This state and the roll gap position according to the present invention where the kiss roll state is set so that the sum of the backup roll reaction forces at the work side and the drive side becomes a predetermined value and the difference of the rolling direction forces acting on the roll chocks of the work side of the work roll and the roll chocks of the drive side is within 1% is made the rolling zero adjustment position.

In this state, 50 sheets of ordinary steel plate of an entrance side plate thickness 30 mm, a plate width of 3000 mm, and otherwise the same dimensions were rolled to give a rolling mill exit side plate thickness of 21 mm using the camber control method disclosed in PLT 9. As a result, regarding the meandering and camber of the rolled material, with rolling by the method of the present invention in the state performing the method of zero adjustment based on the difference of the rolling direction forces acting on the roll chocks at the work side ad the drive side of the work roll at the work side and the drive side, in the 50 rolled plates, there was no meander or camber extending from the front end to the tail end of the rolled material. As opposed to this, with rolling in the state of performing only the method of rolling zero adjustment based on the difference of the backup roll reaction forces in the rolling direction at the work side and the drive side, remarkable camber of 5 mm or more occurred at the front ends of four of the 50 rolled plates.

As a result, according to the present invention, high precision zero point adjustment of left-right asymmetric control of roll gap can be realized. It was learned that it is possible to eliminate flat shape and dimensional precision defects such as camber and plate thickness wedges of the rolled material, or running trouble such as snake motion and tail crush from the front end of the rolled material due to poor setting of left-right asymmetric control of roll gap even right after the front end of the rolled material, which is difficult to control, is bitten into.

Furthermore, zero adjustment is performed to push the roll chocks of the work side and the roll chocks of the drive side in the rolling direction for zero adjustment. In the hot plate rolling mill shown in FIG. 2, a kiss roll test was conducted so that the sum of the backup roll reaction forces at the work side and the drive side becomes 10000 kN. The work roll diameter was 800 mm, while the backup roll diameter was 1600 mm. Further, the rated load was 30000 kN. The test method was the same as above.

When changing the cross angle from −0.1° to +0.1°, the change in the left-right asymmetrical roll gap zero point in the method of rolling zero adjustment based on the difference of the rolling direction forces at the work side and the drive side acting on the roll chocks at the work side and the drive side of the work rolls was 0.03 mm or less. That is, it was learned that the present invention enables high precision rolling zero adjustment without being affected by any thrust force formed between rolls due to the cross angle between rolls.

In addition, by using the method of pushing the roll chock of the work side and the roll chock of the drive side in the rolling direction for zero adjustment (means of (6)), the response in measurement and the measurement precision of the rolling direction force become excellent and the time required for the work can be shortened. Note that, using the method described in claim 6, the same procedure was performed as in the above example for zero point setting. In that state, 50 ordinary steel plate of an entrance side plate thickness of 10 mm, a plate width of 1000 mm, and otherwise the same dimensions were rolled to a rolling mill exit side plate thickness of 8 mm using the camber control member disclosed in PLT 9. As a result, regarding the meandering and camber of the rolled material, none occurred from the front end to the tail end of the rolled material even while rolling 50 plates.

Furthermore, the method of pushing the roll chock of the work side and the roll chock of the drive side in the rolling direction from the side opposite to the side where the work roll was offset with reference to the backup roll (means of (7)) was used in the heavy plate rolling mill shown in FIG. 2 to run a kiss roll test so that the sum of the backup roll reaction forces at the work side and the drive side became 20000 kN. The work roll diameter was 1000 mm, and the backup roll diameter was 2000 mm. Further, the rated load was 60000 kN. The test method was the same was the above.

When changing the cross angle from −0.1° to +0.1°, the change in the left-right asymmetrical roll gap zero point in the method of rolling zero adjustment based on the difference of the rolling direction forces at the work side and the drive side acting on the roll chocks at the work side and the drive side of the work rolls was 0.03 mm or less. That is, it was learned that the present invention enables high precision rolling zero adjustment without being affected by any thrust force formed between rolls due to the cross angle between rolls. In addition, the method of pushing the roll chock of the work side and the roll chock of the drive side in the rolling direction from the side opposite to the side where the work roll was offset (means of (7)) was used, whereby the measurement response and the measurement precision in the rolling direction force became excellent and the time required for work could be shortened.

Furthermore, work with a pushing force smaller than the example of claim 6 becomes possible, so external disturbance factors in measurement such as sliding resistance caused by wear between the roll chocks and housing or hydraulic cylinder etc. can be made smaller and higher precision measurement becomes possible. Note that, using the method described in claim 7, in the same way as the above example, in the zero point state, 50 ordinary steel plate of an entrance side plate thickness of 20 mm, a plate width of 2000 mm, and otherwise the same dimensions were rolled to a rolling mill exit side plate thickness of 16 mm using the camber control method disclosed in PLT 9. As a result, regarding the meandering and camber of the rolled material, none occurred from the front end to the tail end of the rolled material while rolling 50 plates.

EXAMPLE 2

Next, zero adjustment was performed using a hot rolled thick-gauge plate rolling mill with a work roll diameter of 600 mm, a work roll barrel length of 4000 mm, a backup roll diameter of 1200 mm, a backup roll barrel length of 4000 mm, and a rated load of 30000 kN.

First, the work rolls were driven to set a kiss roll state where the rolling load becomes 10000 kN. The work side and the drive side were simultaneously rolled whereby the work side became 5050 kN, and the drive side became 4950 kN. This state is referred to as the "zero point 1".

Here, if measuring the rolling direction forces, at the work side, 90 kN was detected at the entrance side of the upper work roll, while at the drive side, 110 kN was detected at the entrance side of the upper work roll. Therefore, the difference of the rolling direction forces becomes ±10% of the average of the rolling direction forces.

After the zero adjustment of the zero point 1, plate with a width of 2 m and a thickness of 20 mm was hot rolled for 20% reduction.

Next, the rolling force of the work side was reduced and the rolling force at the drive side was increased to make both become 5000 kN. This state is referred to as the "zero point 2". If measuring the rolling direction forces at this time, at the work side, 87.5 kN was detected at the entrance side of the upper work roll, while 112.5 kN was detected at the entrance side of the upper work roll. That is, it was learned that by changing the rolling force between the work side and the drive side 50 kN at a time, the rolling direction force changes by about 2.5 kN. Note that, in this state, the difference of the rolling direction force becomes ±12.5% of the average of the rolling direction force.

After the zero adjustment of the zero point 2, similarly plate with a width of 2 m and a thickness of 20 mm was hot rolled for 20% reduction.

Furthermore, next, for the zero point 2, the rolling force was increased by 250 kN at the work side, while the rolling force was decreased by 250 kN at the drive side. As a result, the rolling direction forces at the work side and the drive side respectively become 99 kN to 101 kN. At this time, the rolling load at the work side becomes 5255 kN, while the rolling load at the drive side becomes 4745 kN. This state is referred to as the zero point 3. In this state, the difference of the rolling direction force becomes ±2% of the average of the rolling direction force or within the scope of the present invention.

After the zero adjustment of the zero point 3, similarly plate with a width of 2 m and a thickness of 20 mm was hot rolled for 20% reduction.

After the zero adjustment of the zero points 1, 2, and 3, plate with a width of 2 m and a thickness of 20 mm was hot rolled for 20% reduction. As a result, at the samples with zero points adjusted by the zero point 1 and zero point 2, camber of 50 to 100 mm occurred per 10 m. However, at the samples with zero points adjusted by the zero point 3, had cambers kept down to less than 10 mm per 10 m.

Note that, the examples in the above embodiments are illustrations of the present invention. The embodiments of the present invention are not limited to these examples of the embodiments.

Industrial Applicability

The present invention can be applied to a rolling mill and a method of zero adjustment of the same, in particular can be applied to a rolling mill which enables high precision zero adjustment in left-right asymmetric components of the rolling mill and a method of zero adjustment of the same.

REFERENCE SIGNS LIST

1*a* upper work roll
1*b* lower work roll
2*a* upper backup roll
2*b* bottom backup roll
3*a* upper work roll chock
3*b* lower work roll chock
4*a* upper backup roll chock
4*b* bottom backup roll chock
5*a* upper work roll chock exit side load detecting device
5*b* lower work roll chock exit side load detecting device
6*a* upper work roll chock entrance side load detecting device
6*b* lower work roll chock entrance side load detecting device
7 hydraulic rolling system
8 housing
9 rolling load detecting device
10*a* upper work roll rolling direction force calculating device
10*b* lower work roll rolling direction force calculating device
11 work side work roll rolling direction composite force calculating device
12 drive side work roll rolling direction composite force
13 rolling direction force difference calculating device
14 left-right asymmetric control of roll gap quantity calculating device
15 left-right asymmetric control of roll gap device
16 entrance side work roll chock pushing device
17 exit side work roll chock position control device
18 exit side work roll chock position detecting device
19 thrust force
20 moment due to thrust force
30 rolling mill

The invention claimed is:

1. A rolling mill which has at least one upper and lower pair of a work roll and a backup roll, the rolling mill comprising:

rolling devices positioned at a work side and a drive side, configured to close the upper and lower pair of backup rolls in a gap direction, load detecting devices for measuring rolling direction forces in a kiss roll state acting on roll chocks at the work side of the work roll and on roll chocks at the drive side of the work roll, rolling load detecting devices for measuring backup roll reaction forces at the work side and the drive side in a kiss roll state, a rolling direction force difference calculating device for calculating a difference of the rolling direction forces acting on the roll chocks at the work side and the roll chocks at the drive side measured by the load detecting devices, a left-right asymmetric roll gap control quantity calculating device for using the calculated value of the rolling direction force difference calculating device to calculate left-right asymmetric roll gap control quantities at the work side and the drive side of the rolling mill, and a left-right asymmetric roll gap control device for controlling the rolling devices at the work side and the drive side of the rolling mill based on the calculated values of the left-right asymmetric roll gap control quantity calculating device, the left-right asymmetric roll gap control quantity calculating device configured to calculate the left-right asymmetric roll gap control quantities at the work side and the drive side of the rolling mill so that a sum of detected backup roll reaction forces at the work side and the drive side in the kiss roll state becomes a value of within ±2% of a predetermined value and that the difference of the rolling direction forces acting on the roll chocks of the work side of the work rolls and the roll chocks of the drive side becomes a value of ±5% of the average of the rolling direction forces of the work side and the drive side.

2. A rolling mill as set forth in claim 1, characterized in that at either of an entrance side and exit side of the rolling direction of the roll chocks of the work side and roll chocks of the drive side, there is a pushing device for pushing the roll chocks of the work side and the roll chock of the drive side in the rolling direction.

3. A rolling mill as set forth in claim 1, characterized in that among an entrance side and exit side at the rolling direction of the roll chocks of the work side and roll chocks of the drive side, a pushing device is provided for pushing the work chocks of the work side and the work chocks of the driven side at the opposite side from the side where the work rolls are offset from the backup rolls.

4. A rolling mill as set forth in claim 2, characterized in that the pushing device has a function of detecting a rolling direction force.

5. A rolling mill as set forth in claim 3, characterized in that the pushing device has a function of detecting a rolling direction force.

6. A method of zero adjustment of a rolling mill having at least one upper and lower pair of work rolls and backup rolls, the method comprising: closing the upper and lower pair of backup rolls in a gap direction, detecting backup roll reaction forces at a work side and a drive side, setting a sum of detected backup roll reaction forces at the work side and the drive side in a kiss roll state to a value of within ±2% of a predetermined value, measuring rolling direction forces acting at roll chocks of the work side of the work rolls and roll chocks of the drive side of the work rolls, calculating a difference between rolling direction forces at the work side and the drive side, setting left and right roll gap positions of the rolling mill so that this difference becomes a value of ±5% of the average of the rolling direction forces of the work side and the drive side, making set roll gap positions as initial roll gap positions, and rolling material to be rolled, wherein the rolled material has no camber extending from a front end to a tail end of the rolled material.

7. A method of zero adjustment of a rolling mill as set forth in claim 6, characterized by pushing the roll chocks at the work side and the roll chocks at the drive side in the rolling direction.

8. A method of zero adjustment of a rolling mill as set forth in claim 6, characterized by pushing the roll chocks of the work side and the roll chocks of the drive side in the rolling direction from a side opposite to the side at which the work roll is offset from the backup roll among entrance side and exit side of the rolling direction of the roll chocks at the work side and the roll chocks at the drive side.

* * * * *